United States Patent [19]

Carney

[11] Patent Number: 5,033,889

[45] Date of Patent: Jul. 23, 1991

[54] OPEN LOOP CARRIAGE CONTROL FOR DOT-MATRIX PRINTER USING TABLES

[75] Inventor: Michael D. Carney, Havertown, Pa.

[73] Assignee: General Signal Corporation, Stamford, Conn.

[21] Appl. No.: 326,142

[22] Filed: Mar. 20, 1989

[51] Int. Cl.[5] ..... B41J 19/30

[52] U.S. Cl. ..... 400/322; 400/124; 400/903

[58] Field of Search ..... 400/220, 322, 903, 121, 400/124

[56] References Cited

U.S. PATENT DOCUMENTS

| | | | |
|---|---|---|---|
| 4,044,882 | 8/1977 | Weinke | 400/903 |
| 4,203,678 | 5/1980 | Nordstrom | 400/903 |
| 4,468,140 | 8/1984 | Harris | 400/322 |
| 4,693,618 | 9/1987 | Nanagate | 400/322 |
| 4,733,981 | 3/1988 | Takeuchi | 400/322 |
| 4,869,610 | 9/1989 | Nishizawa | 400/903 |

FOREIGN PATENT DOCUMENTS

| | | | |
|---|---|---|---|
| 155083 | 9/1984 | Japan | 400/322 |

*Primary Examiner*—David A. Wiecking
*Assistant Examiner*—Steven S. Kelley
*Attorney, Agent, or Firm*—William G. Miller, Jr.; Harold Huberfeld

[57] ABSTRACT

A method for operating a dot-matrix printer to allow printing in the accelerating and decelerating regions of the carriage traverse, which comprises the steps of: firing the wires for registration at the present position of the carriage and stepping the carriage by energization of a stepper motor driving the carriage for the period required to complete the step when accelerating the carriage or the period required to brake the carriage when decelerating the carriage. These times will decrease as the carriage accelerates to the desired velocity and will increase as the carriage decelerates from the desired velocity.

5 Claims, 7 Drawing Sheets

OPEN LOOP CARRIAGE CONTROL FOR DOT-MATRIX PRINTER USING TABLES

BACKGROUND OF THE INVENTION

In dot-matrix printers, the firing of the wires to register corresponding marks on paper is usually done on the fly, in other words, while the printhead is moving. The printhead, therefore, can completely traverse the width of the paper and print the desired dot pattern at each of a plurality of evenly spaced positions as it traverses the paper without ever stopping. The printhead is usually subjected to selective energization at regular time intervals in order to fire the wires and thus register dots at the selected positions on the paper. It has been the practice to accelerate the carriage before printing is begun and to stop printing before the carriage is decelerated at the end of its travel. Such practices have been necessary in order not to introduce decreased spacing between consecutive printing positions in the accelerating or decelerating areas of the traverse.

In industrial type recorders the width of the chart paper must be kept to a maximum in order to have a maximum resolution in the record. Since the width of the recorder case is limited to the standard rack dimensions typical for industrial mounting, the maximum chart width which is usable for recording is determined in part by the extent of the accelerating and decelerating regions at the beginning and end, respectively, of each traverse unless a means can be found to print in those regions.

It is an object of this invention to provide a method and means for printing with a dot-matrix printer in both the accelerating and decelerating regions of the printhead traverse in order to maximize the width of the printed record for any particular width for the case housing the printer or recorder.

SUMMARY OF THE INVENTION

To carry out the object of this invention there is provided a method for operating a dot-matrix printer of the type which steps the printhead carriage continuously in traverse of the paper on which printing is desired, which method includes the steps of: firing the wires for registration at the present position of the carriage and then stepping the carriage by energizing in the appropriate phase the stepper motor driving the carriage. The time period for energization is obtained from a table which lists times determined previously as those required to complete the particular step involved when the carriage is in the accelerating region of its traverse or those useful to brake the carriage when it is in the decelerating region of its traverse. These times decrease as the carriage accelerates from a stop to a fixed time during the remainder of the carriage traverse until deceleration is required at which point the times increase as the carriage is decelerated to a stop.

BRIEF DESCRIPTION OF THE DRAWINGS

In the drawings, where like reference characters indicate like elements:

FIG. 5 is a graphical representation of the velocity vs. time characteristic of the carriage drive system as the carriage is driven in a complete traverse of the paper to be printed on.

DESCRIPTION OF THE PREFERRED EMBODIMENT

Figure 1:
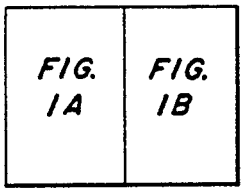
FIG. 1 shows the manner in which FIGS. 1A and 1B can be juxtaposed in order to provide an example of a strip chart recorder to which the present invention can be applied.
Figure 1A:
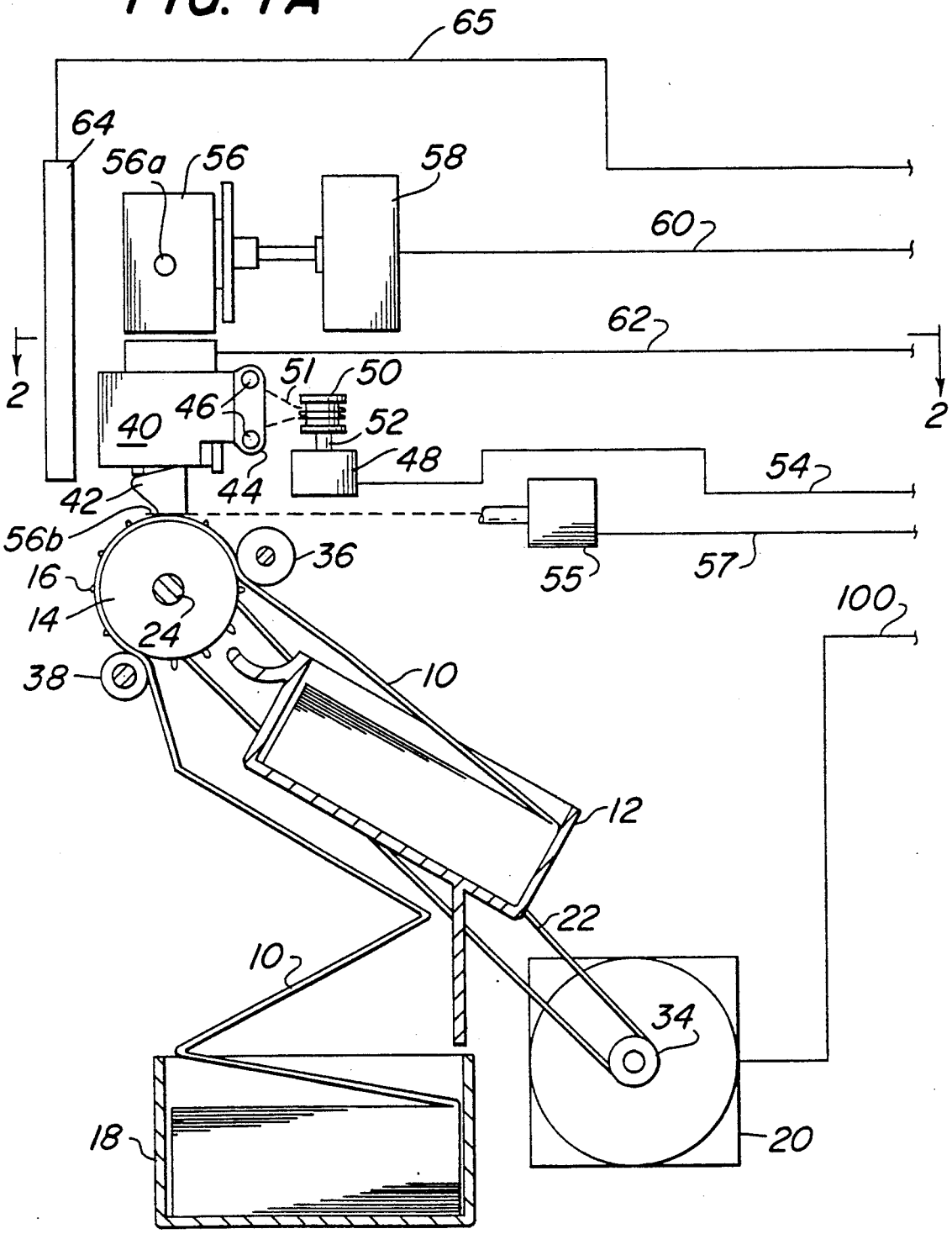
FIG. 1A is a side view, partially in cross section, of a recorder which can be used in carrying out the invention.

In FIG. 1A, a recorder is shown having fanfold chart paper 10, of the type which has sprocket holes in its edges to accommodate driving sprockets. The chart 10 is shown being fed from a supply tray 12, located toward the back of the recorder, over a cylindrical paper drive roll or platen 14, located near the top front of the recorder. The drive roll is shown as having drive sprockets, such as 16, located around its periphery at each of its ends for engaging the sprocket holes. The chart is fed from the drive roll into a collection tray 18, located below the drive roll, as the drive roll is driven by the chart drive motor 20. This motor is preferably a stepping motor so that the chart is driven in discrete steps in order that it may be accurately positioned at certain times in the recording process so as to locate each individual recorded point along the length of the chart at a position indicative of the time when that point was sampled. The stepper motor drives the chart through a belt 22 which is desirably a reinforced rubber timing-tooth belt that has zero backlash in both directions in order to provide a precise positioning of the drive roll. As shown, a fixed shaft 24 supports the drive roll in a frame 30 through bearings in each end of the roll so that the roll may rotate on the shaft. On one side of the drive roll, a timing belt pulley 32 is fitted to the drive roll for driving by the belt 22. The other end of the drive belt is engaged by the timing belt drive pulley 34. Both the driven pulley 32 and the drive pulley 34 have teeth spaced to match the teeth of the timing belt 22 so that the desired positive positioning of the paper drive roll can be accomplished in steps of suitable size.

It is important that the chart paper should be firmly maintained in contact with the chart drive roll 14 and its sprockets 16 so that there will be no backlash in the drive of the chart in either a forward or backward direction. To maintain a constant driving relationship between the chart paper and the sprockets, the rollers 36 and 38 are provided. The roller 36 is a V-grooved roller in that its periphery has a V-groove for receiving the drive sprockets, such as 16, in order that the edges of the roller 36 will maintain the paper in sprocket engagement.

In the recorder of FIG. 1A, the record is impressed on the chart 10 by a printing mechanism 40, which consists of an impact type printhead such as dot-matrix printhead 42 and a carriage 44 for supporting the printhead and carrying it across the chart on a pair of horizontal rails 46 so that the printhead will traverse the full width of the chart 10 in response to the stepping of the carriage positioning motor 48. The motor 48, which is a stepping motor, is coupled to the carriage of the printing mechanism by a tensioned drive cable 51. The carriage drive is accomplished through a capstan 50 mounted on the shaft 52 of the carriage drive motor.

The printhead is of the type utilized in dot matrix printers in that it uses a number of wires which are selectively fired in response to electrical signals to cause the wires to impact on the printer ribbon **56*b* to thereby impress a "dot" on the chart beneath the printer ribbon for each of the wires fired. By way of example, the wires in the print head may be 8 in number and spaced along a line which runs along the length of the chart and is therefore along the time axis of the chart. This spacing can be such that the wires are 1/72 inch apart, which corresponds to one point of type. The carriage positioning motor may advantageously be a stepping motor arranged to selectively position the carriage 44 across the chart in steps of 1/72 inch in response to electrical carriage drive signals received from line 54. As shown in FIG. 1A, the wires contained in the print head are fired selectively by print drive signals received from line 62**.

As is required in most printing mechanisms, the ribbon must be frequently moved under the print head so that there will be a fresh ribbon to provide a clear impression on the chart for each point. The ribbon cartridge 56, which is suspended from a pivot such as **56*a* at each end, contains a supply of ribbon, which is recirculated over the chart by the rotation of ribbon motor 58 in response to signals received from line 60**.

The ribbon may be a multicolor ribbon so that it can print different types of data in different colors. Thus, in the particular recorder being described here by way of example, there are four different color bands on the ribbon. To access these bands the ribbon is shifted laterally by a stepping motor 55 which is mounted on the printhead carriage 44 and which positions the ribbon by positioning a guide through which the ribbon runs so that the guide is moved through four different positions as the cartridge pivots to accommodate the guide movement. The guide is moved by means of a lead screw drive (not shown) which is stepped by motor 55 in response to signals received on line 57. The printhead carriage is caused to traverse the chart four times, once for each position of the ribbon in order to record all of the data which is to be printed in any one color in a single traverse of the carriage so as to minimize the ribbon positioning movement required.

The top front portion of the recorder contains a dot matrix graphic display 64 which receives its input from line 65. That input is such that the display can provide a scale with a pointer to indicate the value of certain inputs, which may or may not be recorded. The display spans the entire width of the chart to provide a visual indication of the values of certain points and to provide a calibration for interpreting the chart record from a distance.

Figure 1B:
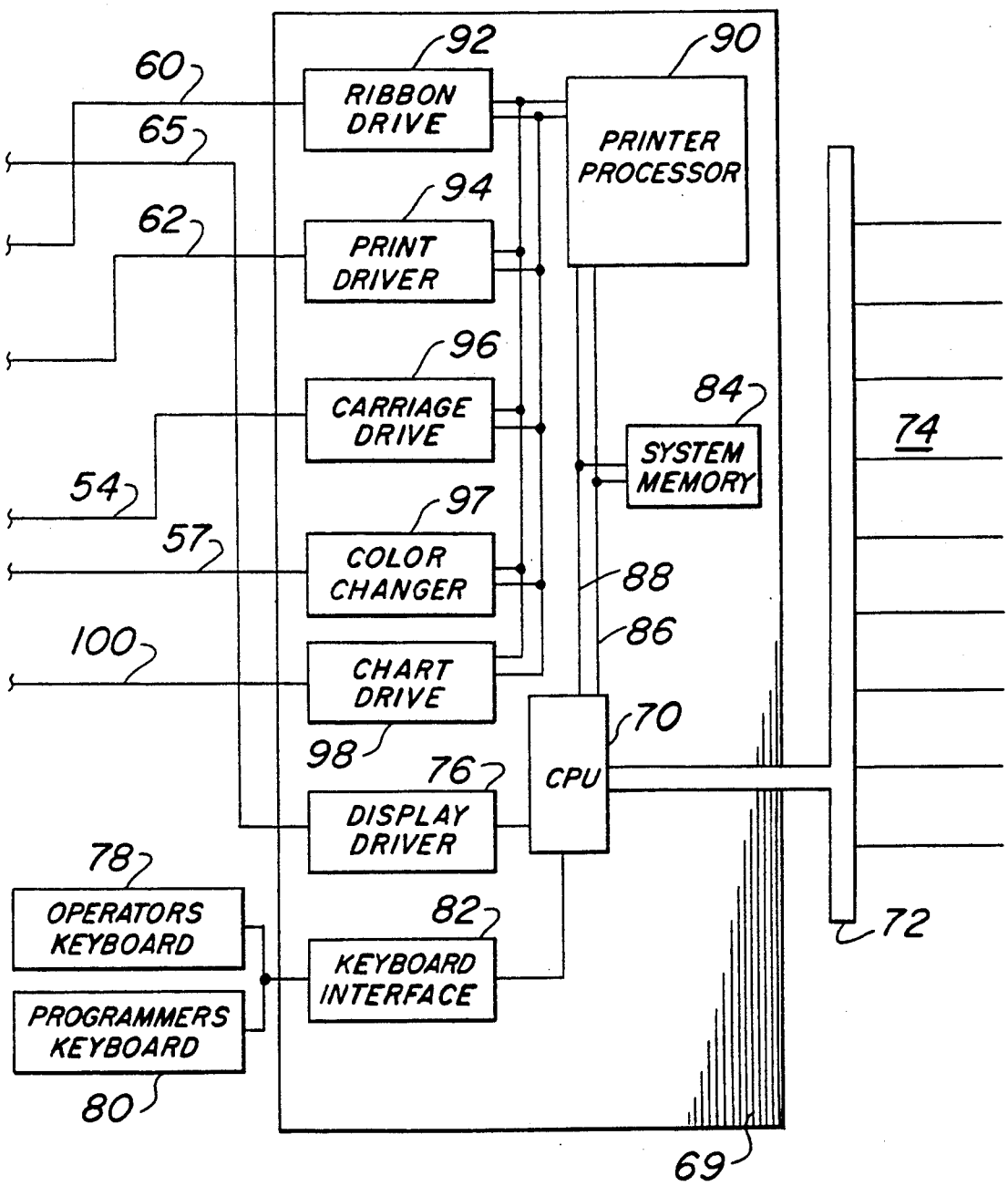
FIG. 1B is a block diagram of a circuit for the recorder of FIG. 1A which can be used to carry out the invention.

FIG. 1B shows a block diagram of the electrical circuits of the recorder of FIG. 1A. Those circuits include a digital computer circuit 69 for operating the recorder and means for providing inputs to the recorder. The heart of the digital computer circuit is, of course, the central processing unit (CPU) 70, which can be a 32016, 16 bit processor. This processor handles the measuring of the inputs which are obtained from the input bus 72 which, in turn, derives its input from the various primary measuring elements associated with the inputs to the input cards 74. Each input card may be designed to receive on its input terminals the signals representing a number of the points to be recorded. These signals may typically be voltages from thermocouples, the resistance of a resistance thermometer, pulse input signals, etc.

The central processor also is coupled to the display drive circuit 76 which provides on line 65 the signals to drive the display 64.

An operators keyboard 78 and a programmers keyboard 80 are also connected to the CPU by way of the keyboard interface circuits, shown as block 82, in order to provide manual input to the computer.

The processing which is carried out by the CPU is done in conjunction with the system memory 84 which is coupled to the CPU by the address bus 86 and the system data bus 88. Also coupled to the CPU is another processor 90, a 64180 processor, which is the printer processor and serves to operate a ribbon driver 92 to control ribbon advance, a print driver 94 to control the firing of the print wires, a carriage driver 96 to control carriage position, a color changer 97 to control which color band on the ribbon is positioned under the printhead, and a chart driver 98 to control chart positioning, both forward and backward, in response to signal supplied on line 100.

Figure 2:
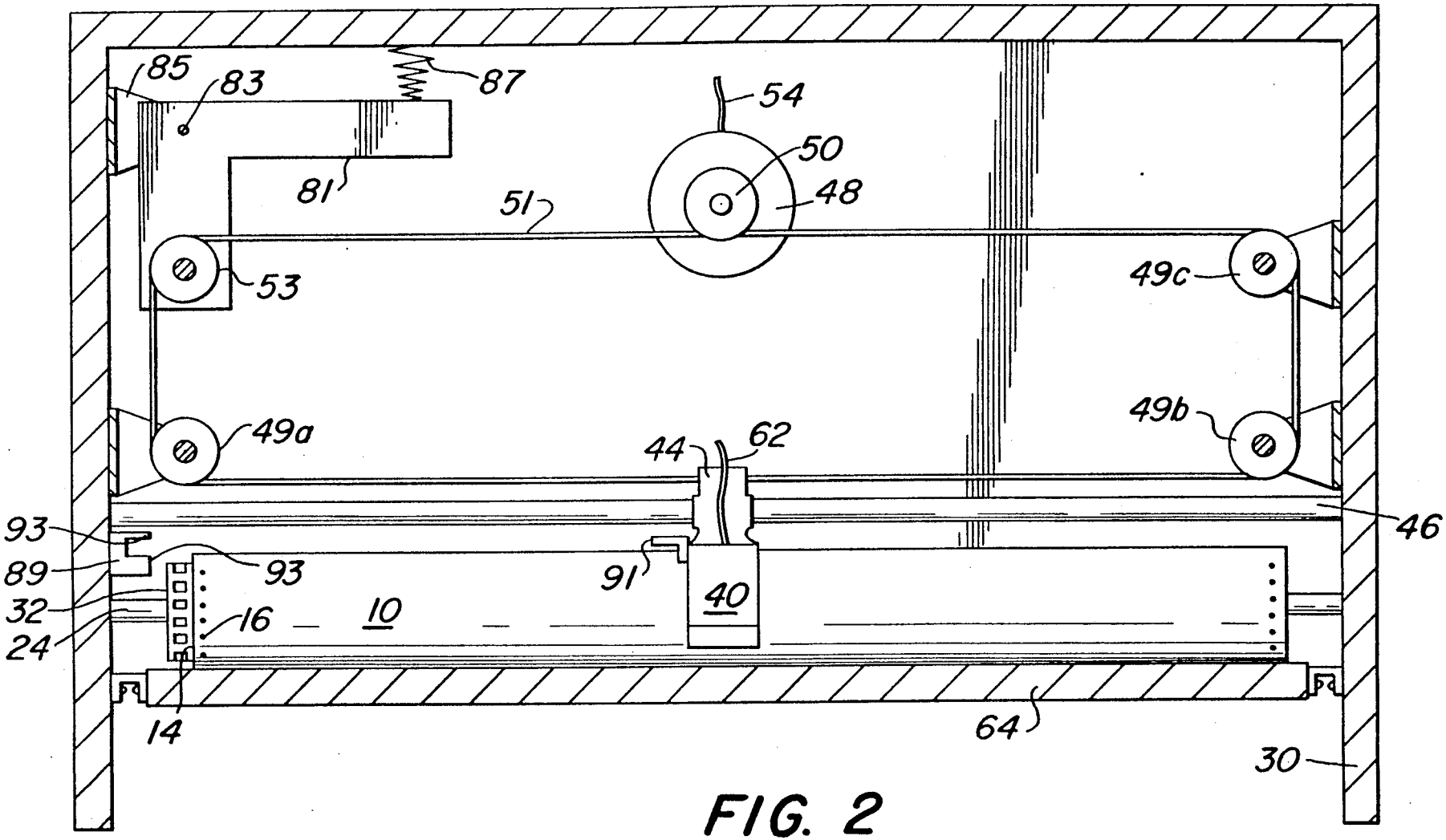
FIG. 2 is a top elevation of a portion of the recorder of FIG. 1A, taken along line 2—2, showing the transport or drive system for the printhead carriage.

FIG. 2 shows a top view of the recorder, taken along line 2—2 of FIG. 1A, to illustrate the path of the cable 51, which is attached to carriage 44 to move it along the rails 46 one step at a time. The idler pulleys **49*a*–49*c* are used to determine the cable path in cooperation with the tensioning pulley 53 which is mounted on a pivoted lever 81. Lever 81 is mounted on pivot 83 which is attached to the frame 30 by bracket 85. The lever 81 is biased by spring 87 in a direction to tension the cable 51 in order to minimize any slack in the cable while the carriage 44 is driven by the capstan 50**.

An optical "home" sensor 89 detects when the tab 91 on carriage 44 is positioned between the extended ears 93 of the sensor so as to interrupt the light beam projected between those ears. When the light beam is interrupted the computer will know that the carriage 44 is in its home position.

In order to drive the printhead carriage so it traverses the chart paper 10, the stepper motor is energized sequentially with different phases so that it repeatedly steps to its next position until the chart has been traversed. The stepper motor 48 is of a type illustrated in FIG. 3, where four field windings are illustrated with the associated field polarities produced by 8 different phases of energization shown as phases A–H. A rotating field will, of course, step the armature with its fixed magnetic poles in one direction or the other depending on the direction of the field rotation. Each change in phase will correspond to a single step of the motor and hence a step to the next printing position for the carriage.

One possible phase sequence for the motor 48 is B-D-F-H, which is known as "full drive" and gives the most torque. Another sequence is A-C-E-G, which is known as "wave drive" and gives less power than does "full drive". A third sequence is A-B-C-D-E-F-G, which is known as "half step" and gives twice the resolution of the other sequences.

Figure 3:
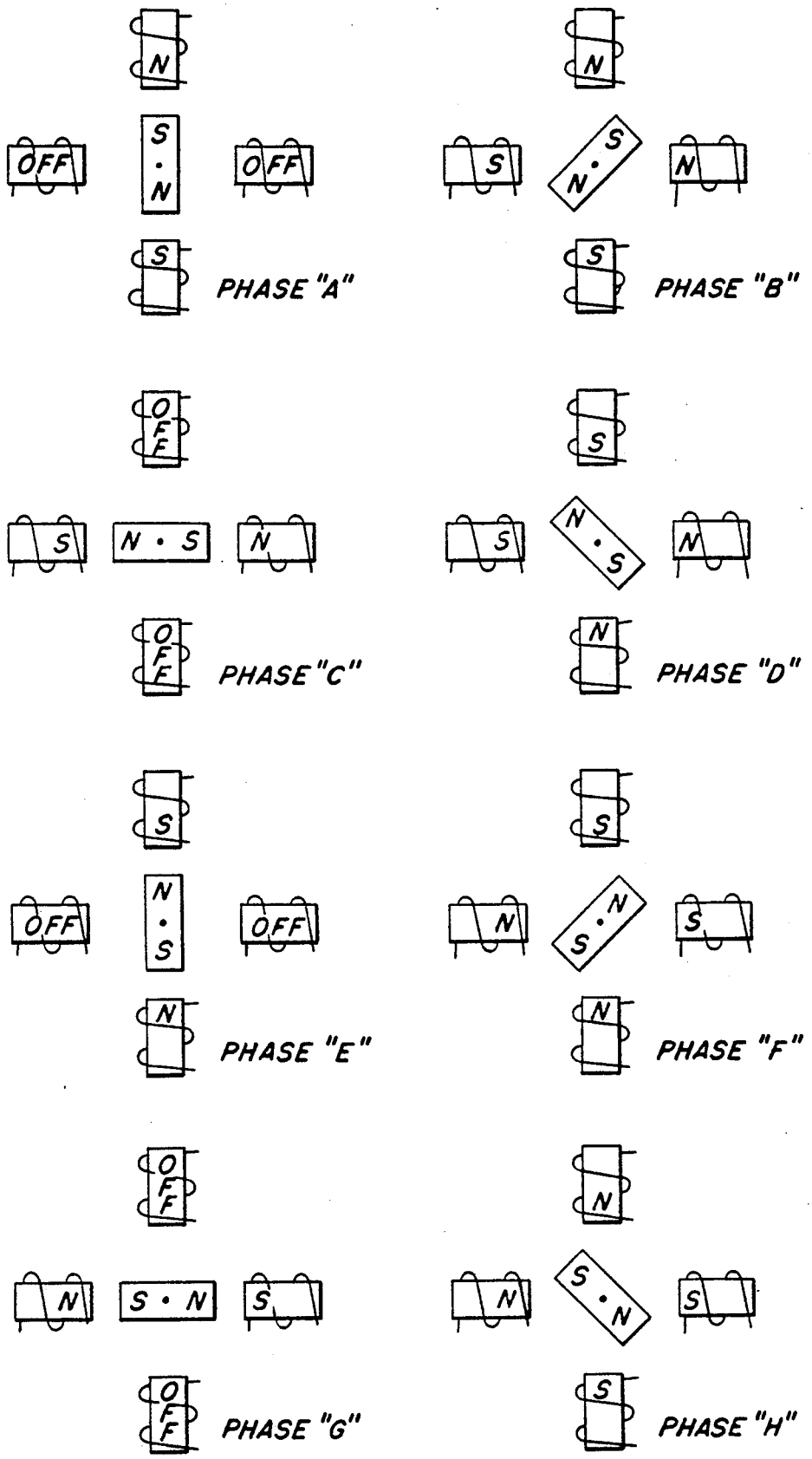
FIG. 3 is a series of diagrams showing the polarity in which the stepper motor fields are energized for the various phases which may be used to drive the motor.
Figure 4:
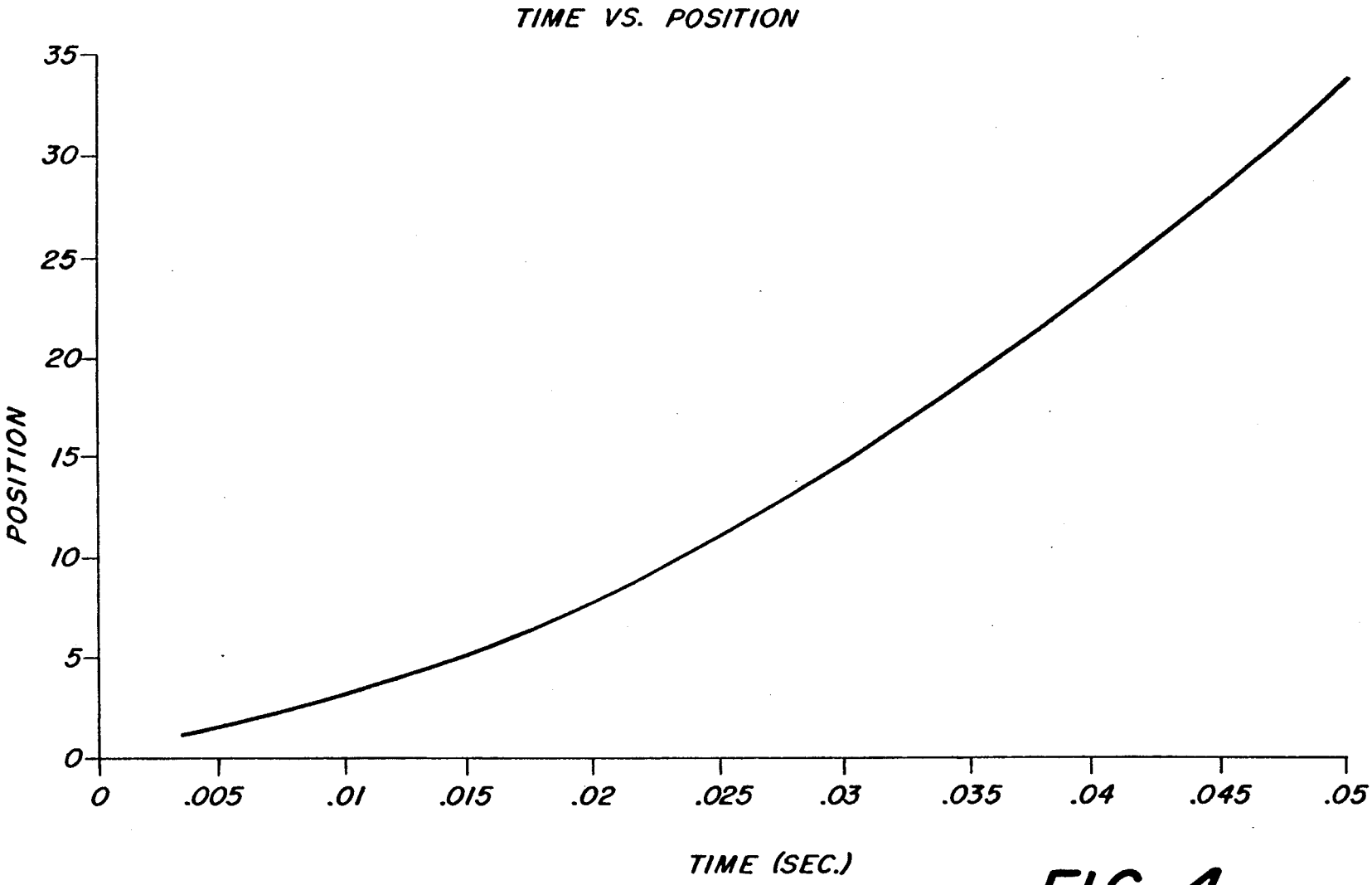
FIG. 4 is a time vs. position characteristic for a typical stepper motor such as may be used to drive the printhead carriage in this invention.

As would be expected, stepping motors of the type shown in FIG. 3 have a time vs. position characteristic of the shape shown in FIG. 4, which shows actual values for the position of the carriage at times up to 0.05 seconds. When the carriage is accelerated at its maximum rate, the carriage velocity increases with time until the carriage gets up to the desired stepping rate after which the carriage can be moved at a constant velocity. It will, of course, be evident from FIG. 4 that, if the printhead is fired at equal time intervals during acceleration of the carriage, the positions at which registration will be made on the chart will not be evenly spaced. Therefore, it is necessary to either wait until the printhead gets up to its desired speed or find another way of printing evenly spaced marks. In the present recorder the printing positions across the chart are spaced apart by 1/72nd of an inch (0.01389 in.). Thus, with the motor characteristic illustrated in FIG. 4, it takes approximately 34 steps to reach full velocity when it is desired to traverse a nominal 12 inch chart in less than 1 sec.

Figure 5:
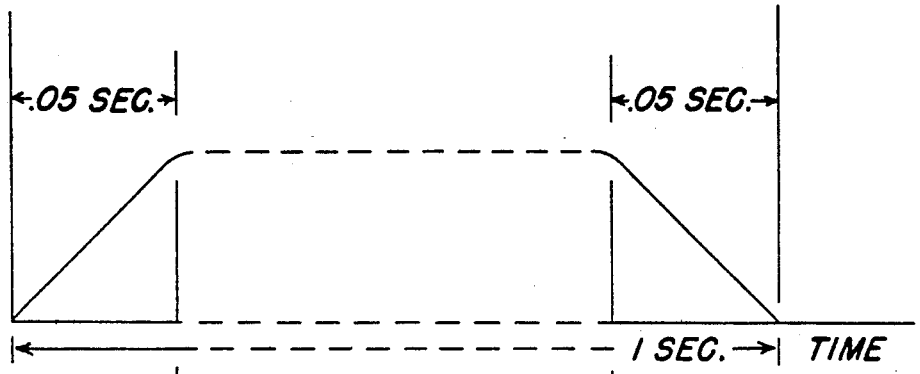

The deceleration region at the end of the carriage traverse presents a similar problem, as is shown in FIG. 5, where velocity is plotted against time for a full traverse.

Figure 6:
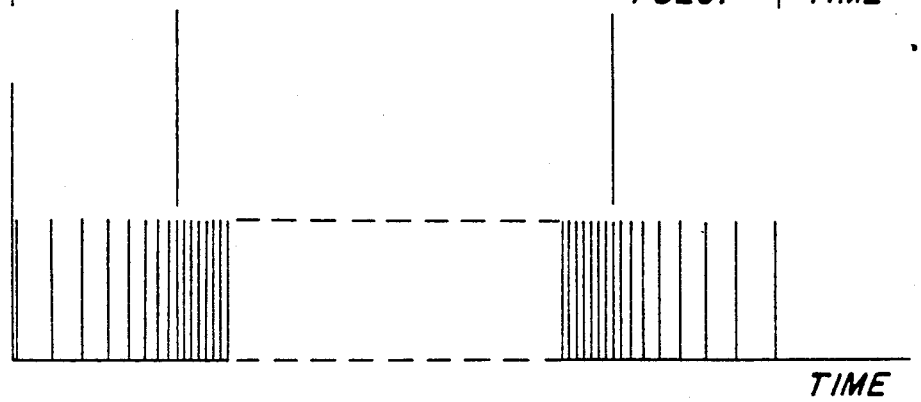
FIG. 6 shows how the time spacing between the wire firing signals changes as the carriage accelerates and decelerates during a single traverse.

In order to get around the need to wait until the carriage has accelerated before printing, the present invention varies the timing of the individual steps, that is, the time period during which the carriage drive motor is energized in the particular phase associated with each step. Thus, the time between the consecutive firings of the wires, at the end of each step, will vary during the acceleration of the carriage. As is shown in FIG. 6, the wire firing signals on line 62 are provided at shorter and shorter intervals as the carriage accelerates until the carriage is at its desired speed, at which time the wires are fired at the same intervals until the carriage need to be decelerated. At that time, the time between consecutive firing signals is gradually increased until the carriage reaches the end of its travel.

By way of example, the "stepper time tables" at the end of the program listing supplied below show the time duration for each step in the accelerating and decelerating regions, that is, the time period for each of the consecutive phases of energization of motor 48 up to the point where the carriage is up to the desired speed and after the point where the speed must be decreased. There is a table for the acceleration region and one, which contains the same times but in the reverse order, for the deceleration region.

Figure 7:
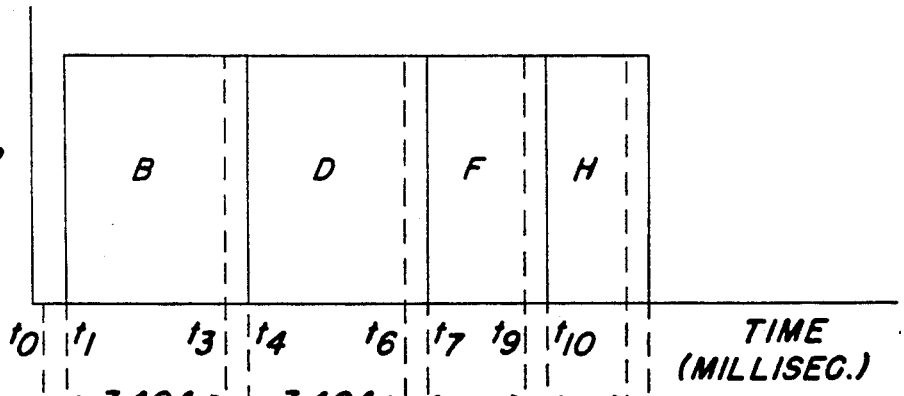
FIG. 7 is a timing diagram showing the duration of the first four phases of energization of the carriage drive motor as the carriage is accelerated from a stop.
Figure 8:
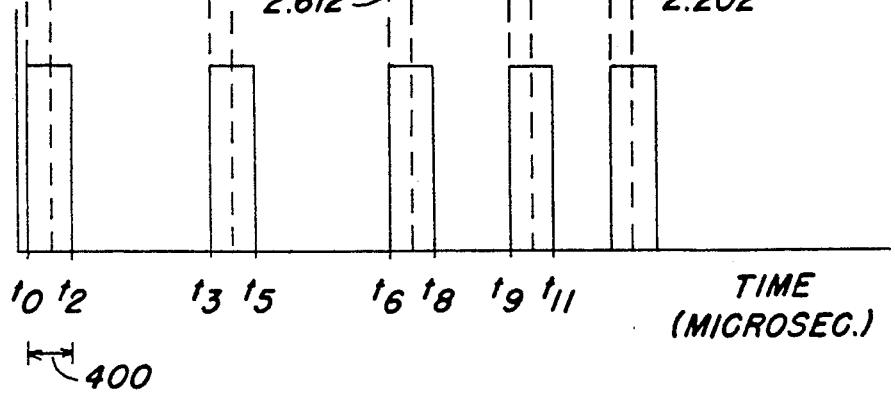
FIG. 8 is a timing diagram showing the timing of the pulses which fire the wires of the dot-matrix printhead as the carriage is accelerated from a stop by the timing of the different phases shown in FIG. 7.

By way of example, FIG. 7 shows the duration of energization of phases B-D-F-H as the carriage begins to accelerate from a stop. Thus, for the first step, after the firing of the wires at $t_0$ in the position at which the carriage was stopped, position zero for example, the motor windings are energized in phase B, as shown in FIG. 3, for 3.404 milliseconds. After that step has timed out, the data determining which wires are to be fired in the next position—the #1 position—is obtained and those wires are fired at $t_3$. A timer is used to time the firing pulses for a standard 400 microseconds, as shown in FIG. 8. It will be noted that the carriage motor remains connected to phase B energization until it is connected for a different phase, as at time $t_4$. The time $t_4$ must occur after the carriage has reached the #1 position and before the carriage has had a chance to slow down by an amount which would prevent the carriage from reaching its next step position before the next wire firing. After time $t_3$, the duration of energization required for the carriage stepping motor in the next step (phase D) is determined and the motor is energized to begin the next step at $t_4$. This step is also for 3.404 milliseconds. After the completion of that second step, the wires for position 2 are fired at $t_6$ by a 400 microsecond pulse. At the end of the D phase, the motor is energized in the F phase for 2.612 milliseconds, to take the carriage to position #3. The wires which must be fired for the 3rd position are fired at $t_9$ and the timing for the next step (phase H) is determined from the stepper table. This time will be found to be 2.202 milliseconds. The carriage is then stepped by energizing the carriage drive motor for that period at $t_{10}$. Subsequent steps are carried out in like manner for the number of steps required to get the carriage up to the desired speed, a total of 34 steps in the apparatus being presently described. After the carriage has reached the desired speed, the duration of each phase will be the same until it is desired to decelerate the carriage, typically the same number of steps, 34, from the end of the carriage traverse.

From the above description of FIGS. 7 and 8, it will be evident that the time period $t_1$–$t_3$, for example, is the time period found in the stepper tables. This is a software time period. The actual time period during which the motor is energized in its proper phase, phase B, is the period $t_1$–$t_4$. However, since the time period $t_3$–$t_4$ will be a constant value the actual duration of energization required by the motor to make the step can be predetermined by subtracting the period $t_3$–$t_4$ from the required period $t_1$–$t_4$ to obtain the software time period $t_1$–$t_3$ for the stepper table. For the purposes of this description the software time periods, as found in the stepper tables, and the actual values for the duration of energization can be used interchangeably as the required or desired duration of energization of the motor, for they are both directly indicative of the actual duration values.

In order to decelerate the carriage gradually, it is appropriate to decelerate in the same number of steps as is required to accelerate. In order to do that, one can utilize essentially the same durations for the steps as is used in the acceleration region, but in a reverse order. Thus, when the carriage has come within 34 steps of the end of its travel, the duration of energization of the carriage drive motor is gradually increased until it reaches the end of its travel. A typical table of energization times for each of the steps will be found at the end of the program listing.

As has been mentioned, the energization of the carriage motor when it is accelerating must be for at least the time required to get to the next position, but it cannot be for a time which will allow the carriage to lose any significant portion of its forward inertia such that it would not be able to complete its next step. In the decelerating region the energization can be for any duration up to that maximum time beyond which the inertia of the system would take the carriage one step position beyond the position desired.

Figure 9:
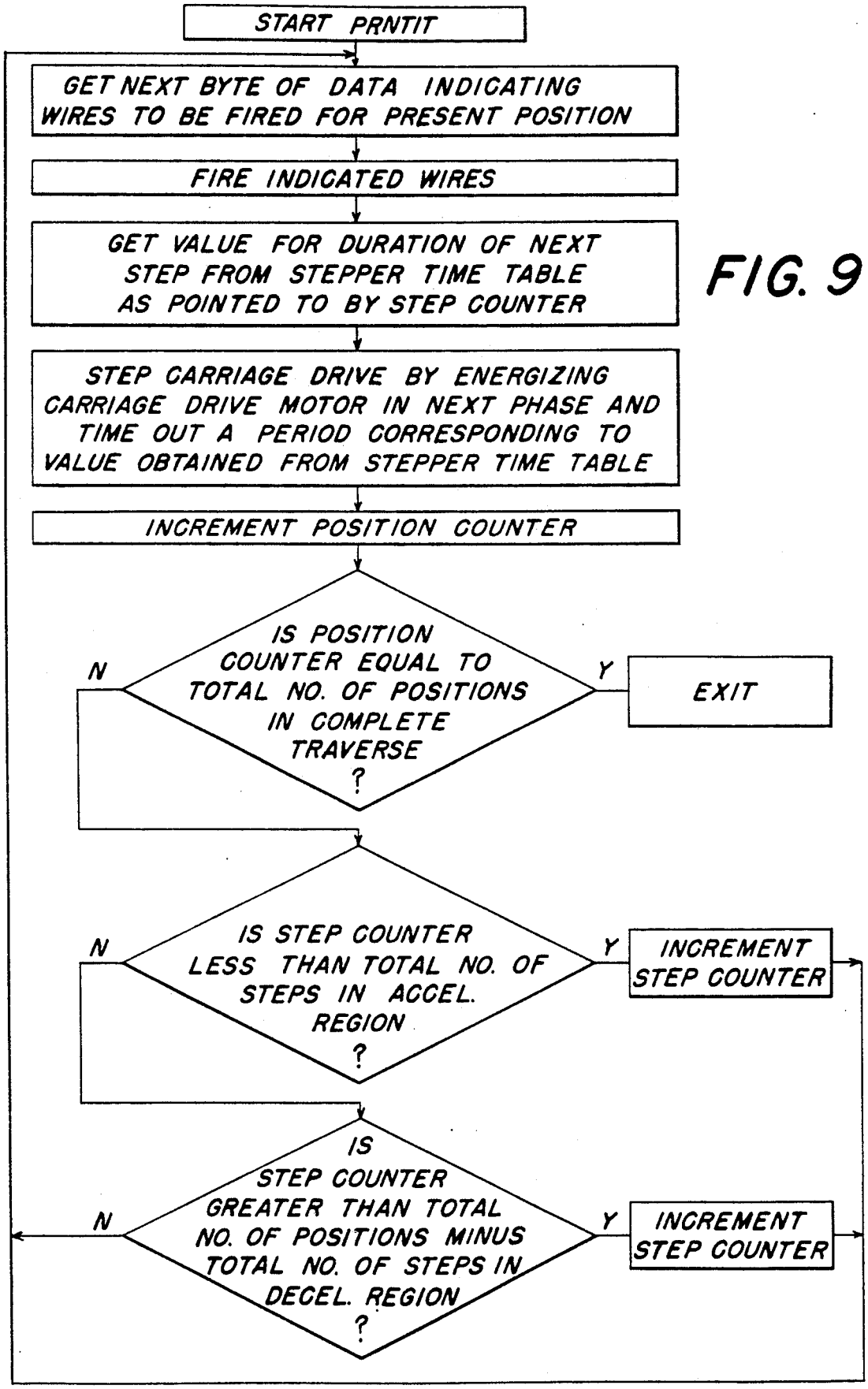
FIG. 9 is a logic diagram showing one series of steps for the process carried out by the invention.

One procedure which can be followed in accordance with this invention is shown in block diagram form in FIG. 9. There, the first step after starting the program "PRNTIT" is shown as requiring the getting of the next byte of data which will indicate the wires of the printhead which are to be fired in the present position. That step is followed by the firing of the wires for the desired period by setting a separate timer to time out 400 microseconds, for example. Then it is necessary to get the value from the "stepper time table", as pointed to by the step counter, for the duration of the next phase which must be applied to the carriage drive motor to complete the next step, assuming more data is to be printed. The carriage is then stepped by energizing the carriage drive motor in the next phase and there is timed out a period corresponding to the value obtained from the "stepper time table". The position counter is then incremented in the appropriate direction and the position counter is looked at to see if it is at the total number of positions which make up a complete traverse. That number may, for example, be 924, which would indicate a complete traverse in the recorder being described. If the position reached is 924, then the program is exited, otherwise, a complete traverse has not been accomplished and the step counter must then be examined to see if it is less than the total number of steps in the acceleration region, 34 in this example. If it is, the step counter is incremented so it will point to the next entry in the table for the acceleration region and the procedure is begun all over again for the next step. If it is not, the step counter is examined to see if it is greater than the total number of positions, 924, minus the total number of steps in the deceleration region, 34, in this example. If the answer is yes, then the step counter is incremented in the table for the deceleration region and the procedure is repeated, otherwise, the procedure is repeated without incrementing the step counter, which means the next step energize the motor for the same duration as for the previous step.

It is, of course, evident that the correct direction of motion must be provided for and that the color of the ribbon under the printhead must be arranged to be appropriate.

Normally, the carriage is started from its home position as detected by the optical sensor 89. It is moved to the other side of the recorder with one color band of the ribbon in place and then after a full traverse the carriage is moved in the opposite direction with another color in place for printing. That return traverse is then followed by two more similar traverses with the remaining two colors printing to complete a cycle of recording in all colors.

It will be recognized that it is not necessary to this invention that a full traverse of the paper be made for each color printed. A partial traverse may be desired. For example, if no data is to be recorded on the right hand half of the chart paper 10 of FIG. 1, it would not be necessary to traverse the whole chart. Thus, the deceleration might be set to start near the middle of the chart. In this connection it will be observed that the entries in the stepper tables are not necessarily associated with particular chart positions, but are associated with the number of steps the carriage is away from the last stopped position, when accelerating, or the next stopped position, when decelerating. Thus, the duration of energization needed for the next step may be said to depend on the duration used for the last step and the sense of the velocity change required. It will be recognized that in the accelerating region the sense of the velocity change required is the opposite of the sense of the velocity change required in the decelerating region.

There is provided below the program listing, entitled PRNTIT, which was mentioned above. It is in assembler language for the 64180 processor. This program describes one method for controlling the movement of the carriage and the firing of the wires in accordance with one form of this invention. That program gives more details of the process which was briefly described above in connection with FIG. 9. As will be evident, other procedures may be used to carry out the method of the appended claims while still being within the ambit of those claims. For example, the firing of the wires may be arranged to begin after the stepping of the carriage instead of before the stepping without in any way decreasing the benefits of the invention.

```
;==========================================================;
;                        === PRNTIT ===
;
;       PRINT DATA IN BUFFER
;
;       <IX> = TIMER INTERRUPT TABLE COUNTER
;       <HL> = POINTS TO DOT DATA LOCATION
;       <BC> = NUMBER OF STEPS TO TAKE
;       <DE> = POINTER TO TIMER INTERRUPT TABLE
;
;==========================================================;
PRNTIT: PUSH AF                     ;SAVE THE REGISTERS
        PUSH BC
        PUSH DE
        PUSH HL
        LD IX,RAMCNT                ;SET UP THE COUNTER
        SUB A                       ;AND SHUT DOWN THE TIMER
```

```
    OUTO (TCR),A
    LD (WAITNG),A              ;CLEAR INTERRUPT FLAG
    LD A,FOURMS                ;RELOAD TIMER
    OUTO (TDROL),A

    LD A,(HLATCH)              ;SETUP FOR FULL POWER
    SET 2,A
    LD (HLATCH),A

;SET POINTERS TO BEGINNING OF PRINT MEMORY FOR THIS PASS

    LD HL,TABLES               ;START OF POINTER
    LD IY,TABLES
    LD A,(COLOR)               ;GET THE COLOR TO PRINT
    AND 0EH                    ;MASK UNWANTED BITS
    LD L,A                     ;<L> NOW POINTS TO PROPER OFFSET

    ADD A,20H                  ;SET UP TO POINT TO COUNT AREA
    LD C,A
    LD B,0
    ADD IY,BC                  ;<IY> NOW POINTS TO COUNT AREA

    LD C,(IY+0)
    LD B,(IY+1)                ;<BC> NOW LOADED WITH COUNT LOCATION

    PUSH BC
    POP IY
    LD C,(IY+0)
    LD B,(IY+1)                ;<BC> NOW HAVE PROPER COUNT

  ; ENSURE WE HAVE ENOUGH TIME TO RAMP-UP AND RAMP DOWN

        SUB A
        CP B
        JR NZ,PRNT                ;IF ANYTHING IN <B> WE HAVE ENOUGH
                                  ;TIME TO RAMP UP AND DOWN
        LD A,RAMPCT               ;IF NOTHING IN <B> THEN CHECK <C>
        CP C
        JP C,PRNT                 ;IF <C> > THE VALUE RAMPCT, WE ARE OK
        LD A,C                    ;NOT HIGH ENOUGH ADD RAMPCT TO THE
                                  ;COUNT
        ADD A,RAMPCT
        LD C,A

PRNT:   LD A,(DIRECT)             ;GET DIRECTION OF THIS PASS
        CP 005H                   ;LEFT TO RIGHT?
        JR Z,PRN1                 ;YES! GO TO THE TABLE
        LD A,L                    ;NO! RECOVER THE DATA AND
        ADD A,10H                 ;ADD OFFSET FOR RIGHT TO LEFT
        LD L,A
```

```
PRN1:   PUSH HL
        POP IY                  ;<IY+0> POINTS TO PROPER TABLE
        LD L,(IY+0)
        LD H,(IY+1)

    ; THE <HL> NOW POINT TO THE PROPER DOT DATA BUFFER.
    ; THE <BC> HAS THE PROPER STEP COUNT LOADED.

        LD A,(DIRECT)           ;GET THE DIRECTION OF THIS PASS
        CP 005H                 ;GOING TO THE RIGHT?
        JR Z,PRN                ;YES! PRESS ON.
        ADD HL,BC               ;NO! GO SETUP FOR END OF THE BUFFER
        LD A,L
        SUB 1
        LD L,A

PRN:    LD DE,INTABL            ;SET THE STEP TIME TABLE POINTER
        LD (IX+0),0             ;CLEAR THE RAMPING COUNTER

                                ;NOTE! NO NEED TO LOAD TRR1H & TRR1L
                                ;BECAUSE NEW VALUE IS LOADED AFTER
                                ;EACH INTERRUPT

PRNT1:

    ; IS THE STEP COUNT (<BC>) > RAMPCT/2 VALUE?  NOTE! THIS IS THE
    ; RAMP DOWN FIGURE

        SUB A
        CP B                    ;CHECK HIGH ORDER FIRST
        JR NZ,PRNT1A            ;IF <B> HAS VALUE WE STILL HAVE
                                ;TO GO ON
        LD A,RAMPCT/2           ;<B> IS CLEAR SO CHECK <C>
        CP C                    ;CHECK LOW ORDER NOW
        JP NC,PRNT1P            ;IF DIST > STEP COUNT GO RAMP DOWN

PRNT1A: LD A,RAMPCT/2           ;ARE WE AT THE TOP OF THE RAMP
                                ;TABLE?
        CP (IX+0)
        JR NZ,PRNT1P            ;NOT AT TOP THE INCREMENT TIMER
                                ;POINTER
        DEC DE
        DEC DE                  ;AT TOP THEN MUST DECREMENT  2X FOR
                                ;FULL SPEED

        JR PRNT2J               ;NOW GO LOAD TABLE DATA
```

```
PRNT1P: INC (IX+0)                  ;BUMP RAMP TABLE POINTER

PRNT2J: LD A,(DE)                   ;START TIMER
        OUTO (TDR1L),A
        INC DE
        LD A,(DE)
        INC DE
        OUTO (TDR1H),A
        INO A,(TCR)                 ;START THE TIMER
        OR 22H
        OUTO (TCR),A
        DEC BC                      ;ONE LESS STEP TO MAKE


; THE NEXT SECTION REPLACES THE CALL TO THE "FIRE" ROUTINE
; THIS IS DONE FOR TIMING CONSIDERATION.
        LD A,(HL)                   ;GET DOT DATA
        OUT (PDL),A                 ;FIRE THE WIRE

        LD A,FOURMS                 ;START TIMER = @ 400usec
        OUTO (TDROL),A
        INO A,(TCR)                 ;GET BYTE FROM TIMER CONTROL
        OR 11H                      ;START TIMER
        OUTO (TCR),A
        EI                          ;ENABLE INTERRUPTS

; END OF FIRE ROUTINE

;        LD A,(PDHLTH)              ;THESE FOUR LINES OF CODE ARE FOR
;        XOR 01                     ;SCOPING PURPOSES.  THEY CAUSE A
;        LD (PDHLTH),A              ;TOGGLING WAVEFORM ON U27.19
;        OUT (PDH),A


        CALL STEP                   ;STEP ONE TIME
        EI                          ;ENSURE THE INTERRUPT IS ENABLED

   ;CHECK FOR END OF STEPPING WHEN <BC> = 0

        SUB A                       ;CLEAR THE <A>
        CP B
        JR NZ,PRNT2                 ;NOT DONE GO THROUGH LOOP AGAIN
        LD A,00
        CP C                        ;POSSIBLE DONE CHECK LOW BYTE OF CNTR
        JR Z,PRNTEX                 ;DONE! GO EXIT THE ROUTINE


PRNT2:  CALL WAIT1M                 ;WAIT FOR THE INTERRUPT FOR STEPPING
        LD A,(DIRECT)
```

```
        CP 005H                 ;IF DIRECTION IS LEFT TO RIGHT,
                                ;INCREMENT THE POINTER,
                                ;ELSE DECREMENT IT
        JR NZ,PRNT2D
        INC HL                  ;LEFT TO RIGHT! INCREMENT
        JR PRNT1                ;NOW MOVE TO NEXT STEP

PRNT2D: DEC HL                  ;RIGHT TO LEFT! DECREMENT
        JR PRNT1                ;NOW CONTINUE THE LOOP
PRNTEX: LD A,(DIRECT)           ;NOW CHANGE DIRECTION
        CPL
        LD (DIRECT),A
        LD HL,0D000H            ;NOW ENSURE 400 USEC INTERRUPT
                                ;HAS COME
        LD DE,0D000H
        LD BC,0050H
        LDIR
        SUB A                   ;ENSURE WIRES ARE BACK
        LD (PDLLTH),A
        OUT (PDL),A
        LD A,(HLATCH)           ;TURN OFF THE RIBBON ADVANCE
        SET 4,A
        RES 2,A                 ;AND SET THE CARRIAGE STEPPER TO LOW
                                ;POWER
        LD (HLATCH),A
        OUT (HWDLTH),A
        POP HL                  ;RECOVER THE REGISTERS
        POP DE
        POP BC
        POP AF
        RET                     ;EXIT

        ;STEPPER TIME TABLE

        IF NEWCAR NE TRUE

; THREE ROLLER CARRIAGE

INTABL  DW 03BFH,03BFH,02DBH,0265H,0219H,01E4H,01BBH,019BH
        DW 01B1H,016BH,0158H,0148H,013AH,012DH,0122H,0117H
        DW 010EH,0106H,00FEH,00F7H,00F0H,00EAH,00E4H,00DFH
        DW 00DAH,00D5H,00D1H,00CDH,00C9H,00C5H,00C1H,00BEH
        DW 00BAH,00BAH

; TIMES ARE AS FOLLOWS:
;       3.404, 3.404, 2.612, 2.202, 1.940, 1.754, 1.613, 1.501
;       1.410, 1.334, 1.268, 1.212, 1.162, 1.119, 1.079, 1.44
;       1.012, .982, .955, .931, .908, .886, .866, .848,
;       .830, .814, .798, .784, .770, .757, .744, .732,
;       .721, .721
```

```
DWNTBL  DW 00BAH,00BAH,00BEH,00C1H
        DW 00C5H,00C9H,00CDH,00D1H,00D5H,00DAH,00DFH,00E4H
        DW 00EAH,00F0H,00F7H,00FEH,0106H,010EH,0117H,0122H
        DW 012DH,013AH,0148H,0158H,016BH,01B1H,019BH,01BBH
        DW 01E4H,0219H,0265H,02DBH,03BFH,03BFH

; TIMES ARE AS FOLLOWS:
;       .721, .721, .732, .744,
;       .757, .770, .784, .798, .814, .830, .848, .866,
;       .886, .908, .931, .955, .982, 1.012, 1.44, 1.079,
;       1.119, 1.162, 1.212, 1.268, 1.334, 1.410, 1.501, 1.613,
;       1.754, 1.940, 2.202, 2.612, 3.404, 3.404

        ORG CHKSUM
CHECK   DB 0C9H,0BEH

        END
```

What is claimed is:

1. Apparatus for coordinating the control of the motion and the printing action of a dot-matrix printhead having a plurality of wires mounted in-line for making a sheet of paper by firing those wires selectively in a plurality of positions spaced across the paper as called for by digital data stored serially in a table in accordance with the sequence of positions occupied by the printhead as it is accelerated in traverse of the paper from a stopped position by a stepping motor, comprising:

means for sequentially energizing the fields of said motor at a constant power in different phases to effectively rotate the field polarities and move the printhead stepwise across the paper;

means operable to read said data out of said table serially one byte at a time in a sequence corresponding to the direction of traverse;

means for firing for each position traversed, those individual wires for which a mark is called for by said data, said firing being at a preselected time following the previous phase change which time has been stored in another table and is at least that time required to cause the printhead to arrive at its next position by the time the wires strike the paper and the firing being for a period of time as is required to register corresponding marks on the paper; and means for changing the phase of energization of the motor fields at a predetermined time after firing said wires, said predetermined time being at least that required to allow the wires to register on the paper.

2. A method for coordinating the control of the motion and the printing action of a dot-matrix printhead having a plurality of wires mounted in-line for marking a sheet of paper by firing those wires selectively in a plurality of positions spaced across the paper as called for by digital data stored serially in a table in accordance with the sequence of positions occupied by the printhead as it is caused to traverse the paper between two stopped position by a stepping motor whose fields are sequentially energized at a constant power in different phases to effectively rotate the field polarities and move the printhead stepwise across the paper, comprising the steps of:

reading out of said table the byte of said data corresponding to the position being approached by the printhead as a result of the last phase change;

firing those individual wires for which a mark is called for by said byte of data, said firing being timed to occur at the end of a preselected period following the previous change of phase, which period is obtained from another table which lists the periods for each step which have been determined as the periods required before firing the wires in order for the printhead to reach the next position by the time the wires register on the paper, and said firing being for the period required to register marks on the paper; and changing the phase of energization of the motor fields at a predetermined time after firing said wires as required to advance the motor one step, said predetermined time being at least long enough to allow the printhead to register on the paper.

3. A method for coordinating control of the motion and the printing action of a dot-matrix printhead having wires for printing data as the printhead is accelerated in traverse of equally spaced print positions by a transport system including a stepper motor energized at a constant power in different phases so that the polarity of the motor field rotates to step the printhead through said positions, comprising the steps of:

selectively firing the wires of said printhead as necessary to record data associated with the approaching printhead position said firing occurring at a time following the previous change of phase of the motor as determined solely on the basis of a preestablished table of values listing the time durations after the last phase change required before firing the wires which will be effective cause the printhead to complete each step to the next position substantially at the same time that the wires print the data;

then switching the stepper motor to the next phase as required to step the printhead to the next position, said switching being timed to occur at a predetermined time after the firing of said wires sufficient to allow completion of the printing at the new position.

4. A method for coordinating the control of the motion and the printing action of a dot-matrix printhead having wires for printing a dot-matrix pattern at each of a plurality of evenly spaced positions in the acceleration region of its traverse across a paper intended to receive printed dot registrations in accordance with consecutive bytes of data which are indicative of the pattern of dots to be printed at each of the consecutive positions as the printhead is carried across the paper by a transport system which continuously steps the printhead between a first and second stopped position in response to the action of a stepper motor, said method comprising the steps of:

firing the wires indicated for firing by the byte of data associated with the position being approached by the printhead, said firing being for the period required to effect registration of corresponding marks on the paper at that position and said firing being at the end of a preselected time period following the previous change of phase of the motor as obtained from a table listing the periods for each step, said periods being of duration such that the printhead will be at the position being approached when the wires register; and stepping the printhead to the next position after a predetermined time period following the firing of the wires which is sufficient to allow registration of said wires, said stepping being accomplished by energizing the stepper motor fields at a constant power in the appropriate phase for taking that step.

5. A method for coordinating the control of the motion and the printing action of a dot-matrix printhead having wires for printing a dot-matrix pattern at each of a plurality of evenly spaced positions as counted by a step counter as the printhead traverses across a paper intended to receive printed dot registrations in accordance with consecutive bytes of data which are indicative of the pattern of dots to be printed at each of the consecutive positions as the printhead is carried across said paper between a first and second stopped position by a transport system which continuously steps the printhead in response to the action of a stepper motor, said method comprising the steps of:

firing the wires indicated for firing by a byte of data associated with the present position;

stepping the printhead toward the next position by energizing the stepper motor fields at a constant power in the appropriate phase at a predetermined time after firing said wires as required to allow the wires to register before the stepping and with the duration of energization before the next firing of the wires being solely in accordance with a table of decreasing values listing the durations required at each position of the printhead to move it to the next position in the acceleration region of its traverse before the wires register on the paper, said stepping being continued until the velocity of the printhead reaches the desired value after which the duration is maintained at a fixed value until the deceleration region of its traverse is reached with the duration thereafter being in accordance with another table of values listing substantially the same times as for the acceleration region except in reverse order, said durations being determined solely on the basis of the step count in said counter and without reference to the actual position of the printhead;

interrogating the position counter to see if it has a count indicating that the printhead is at the last position of its traverse; and repeating the above steps over again for the new position if the last position in the traverse has not been reached.

* * * * *